US009777448B2

(12) United States Patent
Yun

(10) Patent No.: US 9,777,448 B2
(45) Date of Patent: Oct. 3, 2017

(54) FLEXIBLE CRASH BARRIER WITH IMPROVED IMPACT ENERGY-ABSORBING CAPACITY

(71) Applicant: KCE ENG CO., LTD., Anyang-si, Gyeonggi-do (KR)

(72) Inventor: Jong Nam Yun, Goyang-si (KR)

(73) Assignee: KCE ENG CO., LTD., Anyang-si, Gyeonggi-do (KR)

( * ) Notice: Subject to any disclaimer, the term of this patent is extended or adjusted under 35 U.S.C. 154(b) by 0 days.

(21) Appl. No.: 14/761,345

(22) PCT Filed: Jan. 16, 2014

(86) PCT No.: PCT/KR2014/000475
§ 371 (c)(1),
(2) Date: Jul. 16, 2015

(87) PCT Pub. No.: WO2014/112805
PCT Pub. Date: Jul. 24, 2014

(65) Prior Publication Data

US 2015/0354155 A1 Dec. 10, 2015

(30) Foreign Application Priority Data

Jan. 17, 2013 (KR) ..... 10-2013-0005212

(51) Int. Cl.
*E01F 15/00* (2006.01)
*E01F 15/06* (2006.01)
*E01F 15/04* (2006.01)

(52) U.S. Cl.
CPC ..... *E01F 15/06* (2013.01); *E01F 15/0423* (2013.01); *E01F 15/0438* (2013.01)

(58) Field of Classification Search
CPC ... E01F 15/0423; E01F 15/0438; E01F 15/06; E01F 15/145; E01F 15/0407
(Continued)

(56) References Cited

U.S. PATENT DOCUMENTS 1,974,232 A * 9/1934 Brown ..... E01F 15/0438 256/13.1
1,999,065 A * 4/1935 Smith ..... E01F 15/0438 256/13.1
(Continued)

FOREIGN PATENT DOCUMENTS

ES EP 2083122 A1 * 7/2009 ..... E01F 15/043
JP 1973-002135 U 12/1975
(Continued)

OTHER PUBLICATIONS

International Search Report issued in corresponding PCT/KR2014/000475 dated Mar. 31, 2014.

*Primary Examiner* — Gregory Binda
*Assistant Examiner* — Nahid Amiri
(74) *Attorney, Agent, or Firm* — Novick, Kim & Lee, PLLC; Sang Ho Lee

(57) ABSTRACT

A crash barrier is provided. The crash barrier includes a plurality of supports, a guard rail, and connection parts which are inclined so as to mutually connect the supports and the guard rail at certain intervals, such that an impact energy-absorbing capacity can be improved by preventing impact energy from being directly applied to the supports in a direction orthogonal to the guard rail.

20 Claims, 17 Drawing Sheets

(58) Field of Classification Search
USPC ..... 256/13.1, 59, 65.02, 65.14; 404/6, 9, 10
See application file for complete search history.

(56) References Cited

U.S. PATENT DOCUMENTS

| | | | | | |
|---|---|---|---|---|---|
| 2,030,782 | A * | 2/1936 | Dennebaum | E01F 15/0438 | 256/13.1 |
| 2,974,934 | A * | 3/1961 | White | E01F 15/0415 | 256/13.1 |
| 3,467,361 | A * | 9/1969 | Moschettini | E01F 15/0438 | 24/115 H |
| 4,910,901 | A * | 3/1990 | Boyar | G09F 7/22 | 40/606.19 |
| 5,152,507 | A * | 10/1992 | Lee | E01F 13/026 | 256/13.1 |
| 5,305,976 | A * | 4/1994 | Blanchard | E04H 12/2215 | 248/156 |
| 5,402,987 | A * | 4/1995 | Duyck | E01F 15/0453 | 256/13.1 |
| 5,462,258 | A * | 10/1995 | Gaillard | E01F 15/0453 | 248/66 |
| 5,730,555 | A * | 3/1998 | Stoner | E04H 12/2215 | 405/244 |
| 6,006,740 | A * | 12/1999 | Ulrickson | F24B 1/205 | 126/25 A |
| 6,644,888 | B2 * | 11/2003 | Ochoa | E01F 15/0438 | 404/6 |
| 6,905,283 | B1 * | 6/2005 | Salyer, Sr. | E01F 15/085 | 404/10 |
| 6,935,622 | B2 * | 8/2005 | Jonsson | E01F 9/629 | 256/13.1 |
| 7,100,903 | B1 * | 9/2006 | Wilson | E01F 15/145 | 256/13.1 |
| 7,556,243 | B2 * | 7/2009 | Williams | E01F 15/06 | 256/12.5 |
| 7,997,824 | B2 * | 8/2011 | Amengual Pericas | E01F 15/0438 | 256/13.1 |
| 8,177,194 | B2 * | 5/2012 | James | E01F 15/025 | 256/13.1 |
| 8,616,802 | B2 * | 12/2013 | Gerrard | E01F 15/0461 | 256/13.1 |
| 2011/0024707 | A1 * | 2/2011 | Williams | E01F 15/0423 | 256/13.1 |
| 2011/0095252 | A1 * | 4/2011 | Dyke | E01F 15/146 | 256/13.1 |

FOREIGN PATENT DOCUMENTS

| | | | |
|---|---|---|---|
| JP | 51-126934 | U1 | 10/1976 |
| KR | 20-0311357 | Y1 | 4/2003 |
| KR | 20-0365416 | A | 10/2004 |
| KR | 1020040098834 | Y1 | 11/2004 |
| KR | 20-0391781 | Y1 | 8/2005 |
| RU | 81213 | U1 | 3/2009 |
| SU | 1087606 | A1 | 4/1984 |

* cited by examiner

FLEXIBLE CRASH BARRIER WITH IMPROVED IMPACT ENERGY-ABSORBING CAPACITY

CROSS REFERENCE TO RELATED APPLICATION

This application claims priority to Republic of Korea Patent Application No. 10-2013-0005212, filed on Jan. 17, 2013 and PCT/KR2014/000475 filed on Jan. 16, 2014.

TECHNICAL FIELD

The present invention relates to a crash barrier which is installed on the side or center of the road in order to prevent a vehicle from deviating from the road or from crossing the centerline of the road.

BACKGROUND ART

A crash barrier is installed on the side or center of the road so as to prevent a vehicle from deviating from the road or from crossing the centerline of the road, to minimize the injury to riders of the vehicle and damage to the vehicle, and to return the vehicle to the road.

A conventional crash barrier has been disclosed in Korean Patent No. 10-0463678. The conventional crash barrier includes a support which is generally installed perpendicular to the ground and a guardrail which is combined with the support. In the conventional crash barrier, a connection member is provided between the support and the guardrail and is coupled at a right angle to the guardrail.

However, in the conventional crash barrier, since the connection member is disposed at a right angle to the support and guardrail, most impact energy applied to the guardrail is directly transferred to the support. That is, the impact energy due to the vehicle collision is directly transferred to the support without being absorbed by the guardrail, so that it is difficult to prevent injury to the riders of the vehicle and damage to the vehicle.

DISCLOSURE

Technical Problem

The object of the present invention is to provide a crash barrier which prevents the impact energy due to the vehicle collision from being directly transferred to the support in a direction perpendicular to the guardrail, thereby improving impact energy-absorbing capacity and efficiently preventing injury to the riders of the vehicle and damage to the vehicle.

Technical Solution

The present invention provides a flexible crash barrier including a plurality of supports which are installed and fixed to the ground at a certain interval in the longitudinal direction of the road; a plurality of continuous guardrails which extend in the longitudinal direction of the road and have straight-line portions connected in such a manner as to overlap each other; a connection part which is disposed to be inclined between the support and the rear side of the guardrail as viewed from the top and connects the support with the guardrail at a certain interval.

In the flexible crash barrier according to the embodiment of the present invention, each of the plurality of guardrails has a straight line portion in the longitudinal direction thereof and an inclined portion in which one end thereof is curved in the rear side direction thereof, and the inclined portion may correspond to the connection part. An end of the straight line portion of the guardrail may be coupled to a shape change initiating area, that is, a position immediately prior to the beginning of the inclined portion of an adjacent guardrail.

In the flexible crash barrier according to the embodiment of the present invention, the connection part may have a straight line shape or a curved line shape and may be comprised of an inclined member separated from the guardrail. One end of the inclined member may be firmly fixed and coupled to the rear side of the guardrail, and the other end of the inclined member may be fixed to and combined with the support.

In the flexible crash barrier according to the embodiment of the present invention, the connection part may have a bent shape and is comprised of a bent member separated from the guardrail. One end of the bent member may be firmly fixed and coupled to the rear side of the guardrail, and the other end of the bent member may be fixed to and combined with the support.

In the flexible crash barrier according to the embodiment of the present invention, the plurality of guardrails and the connection part are provided on both sides of the support in the width direction of the road, so that they may function as a central reservation.

In the flexible crash barrier according to the embodiment of the present invention, an outer surface of the lower portion of the support which is penetrated into the ground may further include a wing member which is composed of a plate member and extends in the longitudinal direction of the support.

Advantageous Effects

The crash barrier according to the embodiment of the present invention has a front side having a continuity in case of a vehicle collision and includes a sufficient space between the guardrail and the support. Therefore, when a vehicle collision, etc., occurs, the vehicle cannot directly contact with the support until the guardrail is sufficiently plastically deformed.

In the crash barrier according to the embodiment of the present invention, since the connection part obtaining a space between the support and the rear side of the guardrail is disposed to be inclined or has a bent shape, the connection part has a modulus of elasticity less than that of the conventional connection part perpendicular to the rear side of the guardrail. Accordingly, at the time of the vehicle collision, a continuous beam composed of the guardrail becomes close to an infinite beam having unclear points, thereby improving impact energy-absorbing capacity.

In the crash barrier according to the embodiment of the present invention, since the connection part obtaining a space between the support and the rear side of the guardrail is disposed to be inclined or has a bent shape, the impact energy due to the vehicle collision is not directly transferred to the support in a direction perpendicular to the guardrail. Accordingly, it is possible to improve the impact energy-absorbing capacity and to efficiently prevent injury to the riders of the vehicle and damage to the vehicle. Further, direct damage to the support is reduced and the crash barrier has a simpler structure, so that manufacture and installation cost of the crash barrier and a time required for installing the crash barrier can be reduced.

BEST MODE

Figure 1:
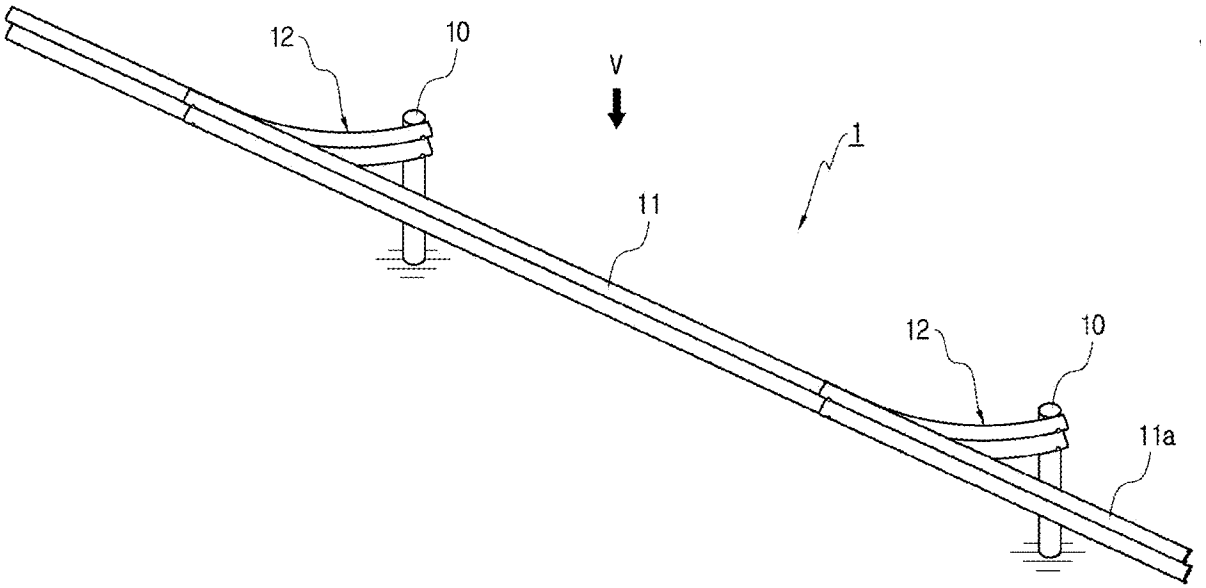
FIGS. 1 and 2 are schematic perspective views of a crash barrier according to a first embodiment of the present invention respectively.

Hereafter, an embodiment of the present invention will be described with reference to the accompanying drawings. While the present invention will be described with the embodiment shown in the drawings, this is just an example and will not limit the spirit, core configurations and operations of the present invention.

Figure 2:
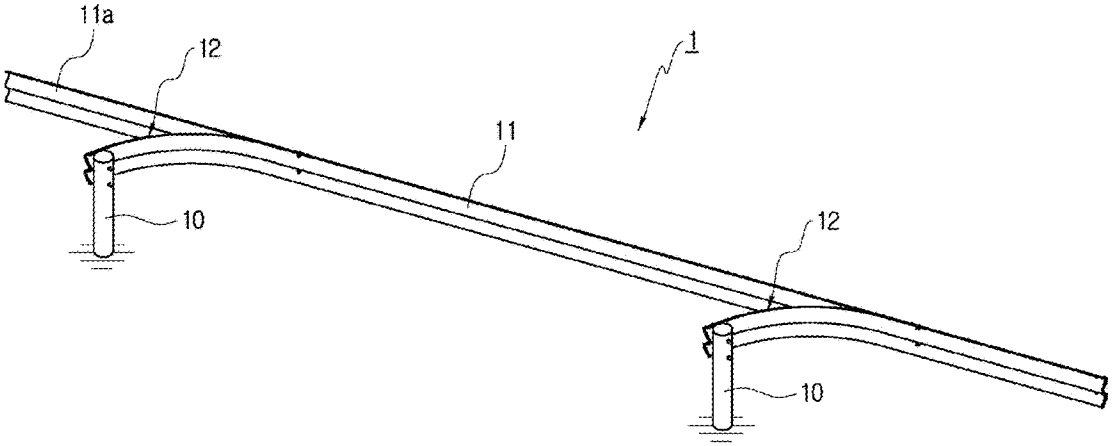
Figure 3:
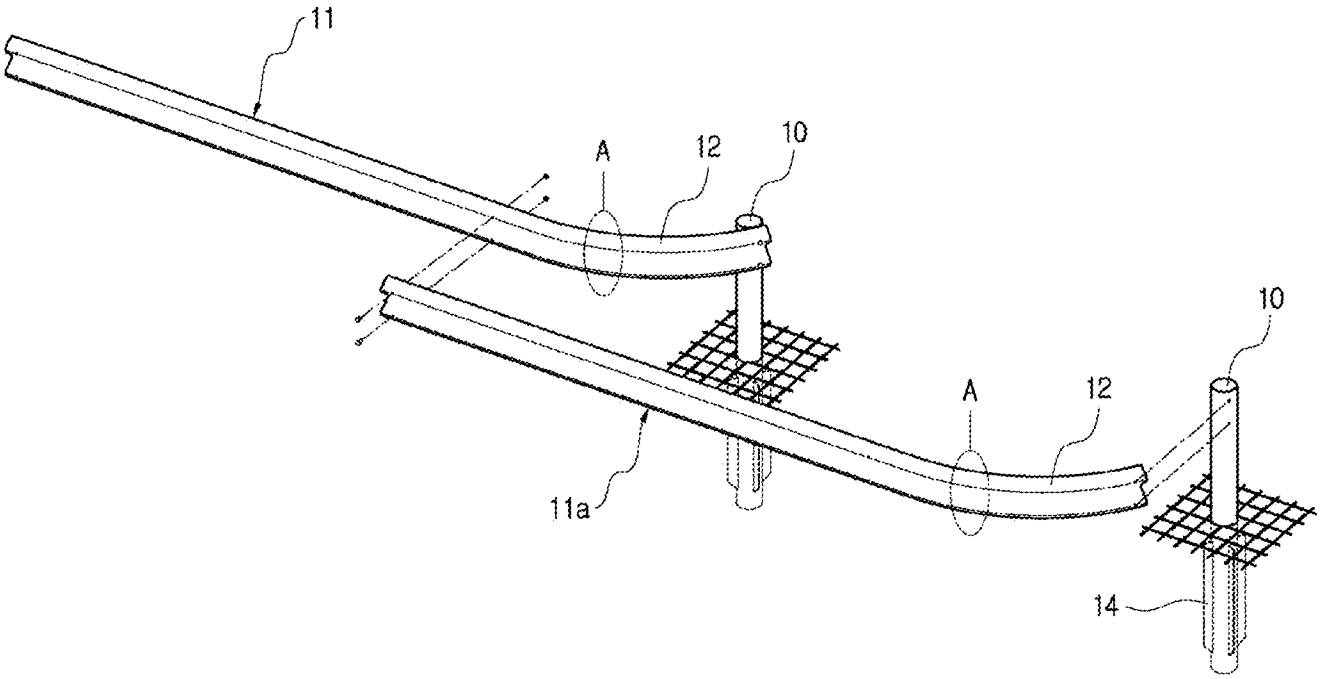
FIG. 3 is a schematic exploded perspective view of the crash barrier shown in FIG. 1 according to the first embodiment of the present invention.
Figure 4:
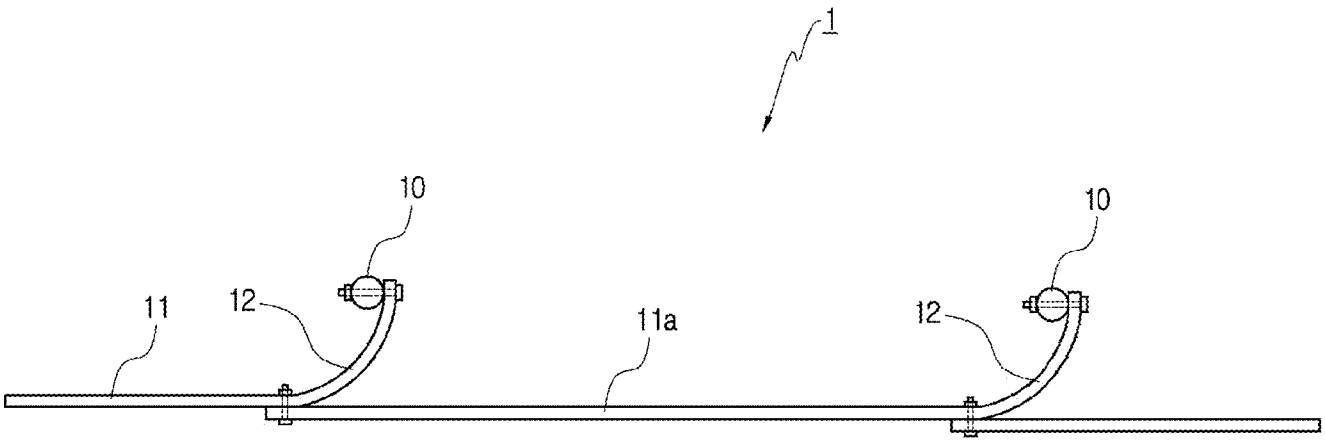
FIG. 4 is a schematic plan view of the crash barrier shown in FIG. 1 according to the first embodiment of the present invention.

FIG. 1 is a schematic perspective view of a crash barrier 1 as viewed from a road such that the front side of the crash barrier 1 according to a first embodiment of the present invention can be seen. FIG. 2 is a schematic perspective view of the crash barrier 1 as viewed from the side of the road such that the rear side of the crash barrier 1 according to the first embodiment of the present invention can be seen. FIG. 3 is a schematic exploded perspective view of the crash barrier 1 shown in FIG. 1 according to the first embodiment of the present invention. FIG. 4 is a schematic plan view of the crash barrier 1 shown in FIG. 1 according to the first embodiment of the present invention (as viewed in a direction of an arrow "V" in FIG. 1). In the drawings, a portion of a support 10, which is penetrated into the ground, is indicated by a dotted line.

As shown in drawings, the crash barrier 1 according to the embodiment of the present invention includes a plurality of supports 10, a guardrail 11, and a connection part 12 which is disposed to be inclined between the support 10 and the rear side of the guardrail 11 as viewed from the top and connects the support 10 with the guardrail 11 at a certain interval.

The lower portion of the support 10 is penetrated into the ground in a direction perpendicular to the ground and fixed to the ground. The plurality of supports 10 are disposed at a certain interval in the traveling direction of the vehicle, i.e., in the longitudinal direction of the road. In the embodiment of the present invention, the support 10 may be made of steel, for example, a pipe member or H beam, etc. However, the support 10 is not limited to be made of the steel and can be made of various materials in a variety of shapes including a concrete pile. Also, in the embodiment of the present invention, since the guardrail and the connection part 12 may be installed in a wall structure, the support 10 in this specification is not limited to a pile-shaped structure. It should be construed that the support 10 is commonly designated as all of the structures to which an end of the connection part 12 is substantially coupled (e.g., a position of a wall structure, to which the connection part is coupled).

When the support 10 is formed in the form of a pile and is penetrated into the ground, the outer surface of the lower portion of the support 10 may further include a wing member 14 which is composed of a plate member and extends in the longitudinal direction of the support 10. A plurality of wing members 14 may be provided along the outer circumference of the support 10. Due to the wing member 14 provided on the support 10, there occurs a large resistance force to a torsional load which is applied onto the support 10 by the vehicle collision. This wing member 14 is provided if necessary and may be omitted.

The vehicle collides directly the guardrail 11. As shown in the drawings, the guardrail 11 may be manufactured of a waveform steel sheet. However, there is no limit to this.

The connection part functions to connect the support 10 with the guardrail 11. In the embodiment of the present invention, as viewed from the top in FIG. 4, the connection part 12 is inclined between the support 10 and the guardrail 11.

In particular, in the first embodiment shown in FIGS. 1 to 4, the connection part 12 is not a separate member. A curved end of the guardrail 11 forms the connection part 12. A plurality of guardrails 11 are continuously coupled to each other in the longitudinal direction of the road. In the first embodiment shown in FIGS. 1 to 4, each guardrail 11 has a straight line portion in the longitudinal direction thereof and an inclined portion in which one end thereof is curved in the rear side direction thereof. In FIGS. 1 to 4, regarding two guardrails which are continuous in the longitudinal direction of the road, reference numerals 11 and 11*a* are assigned to two guardrails respectively for convenience, for the purpose of distinguishing the two guardrails.

As shown in FIGS. 1 to 4, when the guardrails 11 and 11*a* are combined with the support 10, the end of the inclined curved portion of the guardrail 11 is connected to the support 10. The end of the straight line portion of the adjacent guardrail 11*a* is coupled to a shape change initiating area "A", that is, a position immediately prior to the beginning of the inclined portion of the adjacent guardrail 11.

As such, each of the plurality of guardrails in the first embodiment shown in FIGS. 1 to 4 is composed of the straight line portion and the inclined portion. The plurality of guardrails are continuously coupled to each other in the longitudinal direction of the road in such a manner that the end of the inclined portion curved in the rear side direction of the guardrail 11 is combined with the support 10, and the straight line portion of the subsequent guardrail 11*a* is coupled to the front of the adjacent guardrail 11 in the shape change initiating area "A", that is, the position immediately prior to the beginning of the inclined portion of the adjacent guardrail 11 combined with the support 10. Therefore, the fronts of the adjacent guardrails 11 and 11*a* have a continuous linear shape as viewed from the road. In this manner, the adjacent guardrails are continuously and repeatedly coupled to each other, so that the crash barrier 1 according to the embodiment of the present invention is constructed on a road section requiring the crash barrier 1.

The inclined portion may have, as shown in the drawings, a curved line shape as viewed from the top. The inclined portion may also have a shape which is bent from the shape change initiating area "A" at a predetermined angle and is a straight line from the bent position to the end combined with the support 10 as viewed from the top.

As described above, in the first embodiment shown in FIGS. 1 to 4, the inclined portion curved in the rear side direction of the guardrail 11 corresponds to the "connection part 12" obtaining a space between the support 10 and the rear side of the guardrail 11.

Figure 5:
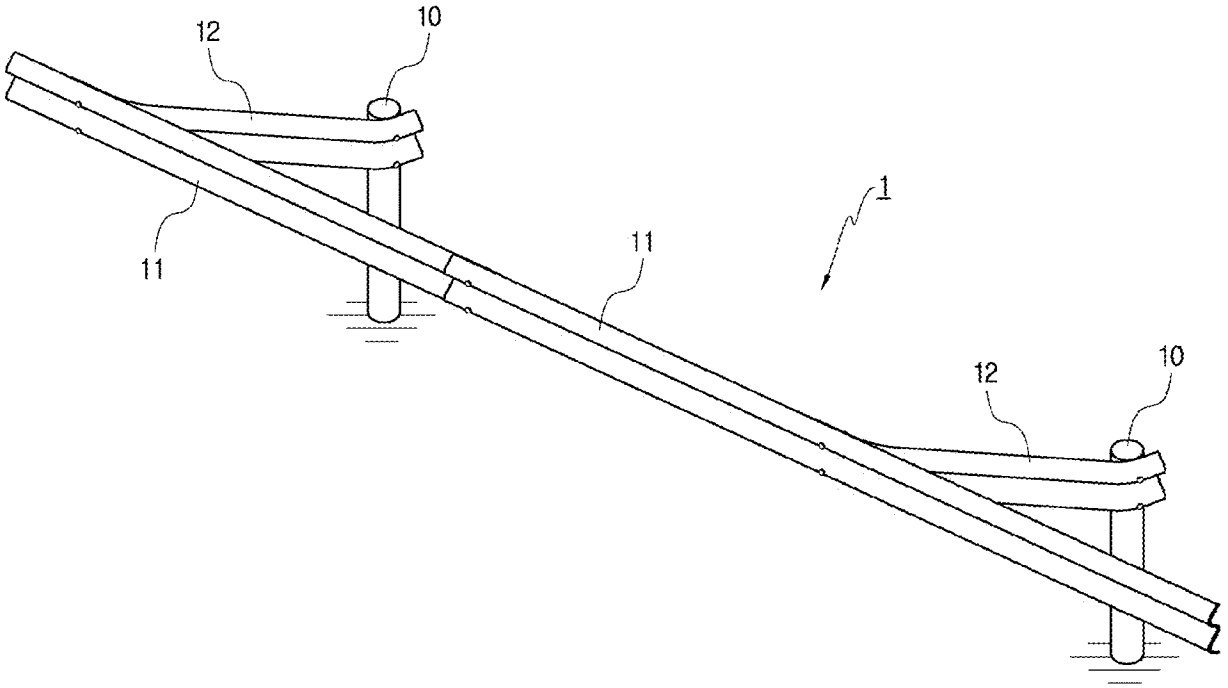
FIGS. 5 and 6 are schematic perspective views of a crash barrier according to a second embodiment of the present invention respectively.
Figure 6:
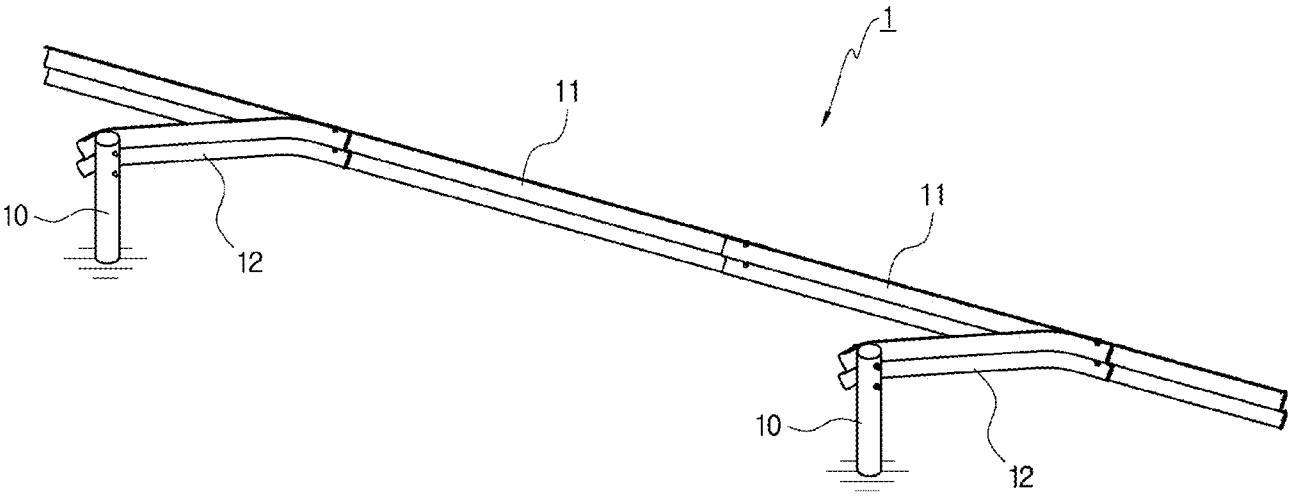
Figure 7:
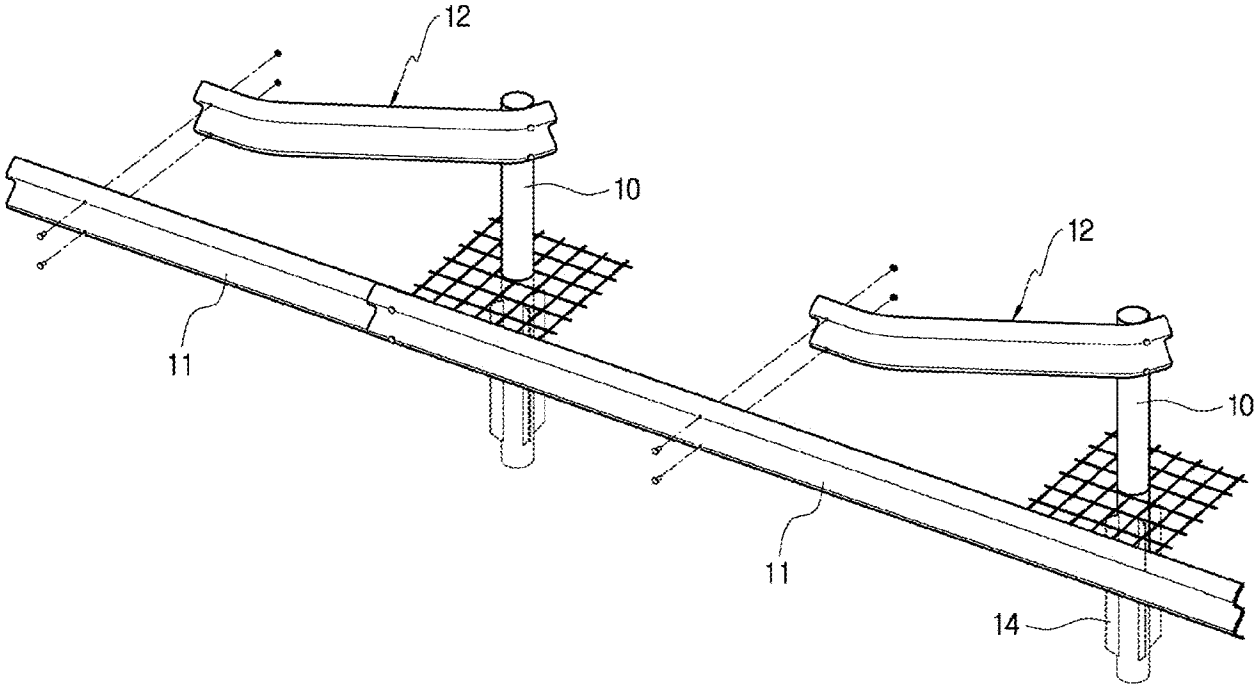
FIG. 7 is a schematic exploded perspective view of the crash barrier shown in FIG. 5 according to the second embodiment of the present invention.
Figure 8:
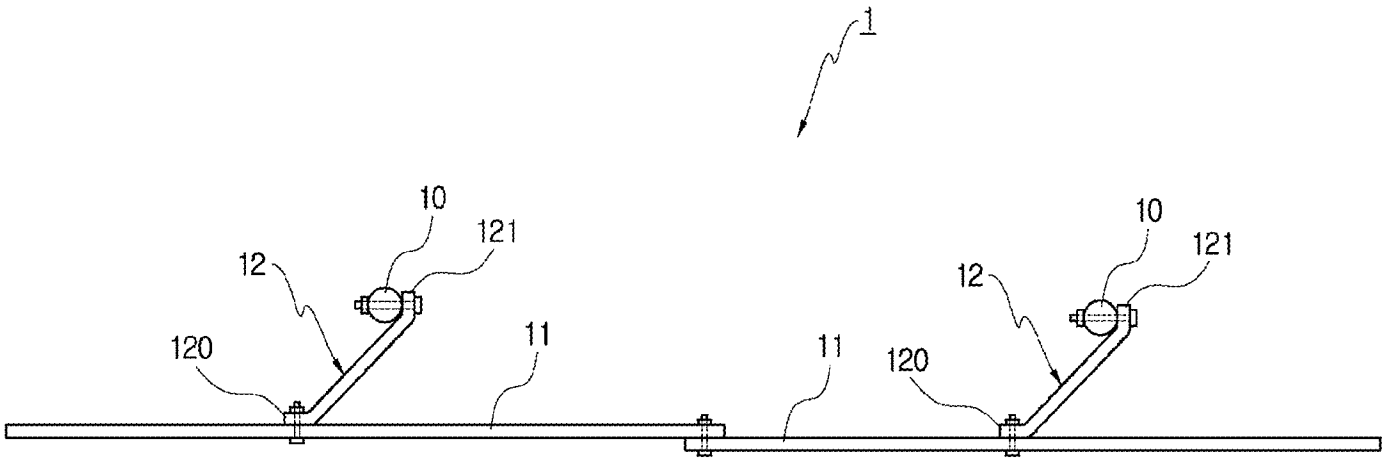
FIG. 8 is a schematic plan view of the crash barrier shown in FIG. 5 according to the second embodiment of the present invention.

FIGS. 5 to 8 are views showing the crash barrier 1 according to a second embodiment of the present invention. Specifically, FIG. 5 is a schematic perspective view of the crash barrier 1 as viewed from the road such that the front side of the crash barrier 1 according to the second embodiment of the present invention can be seen. FIG. 6 is a schematic perspective view of the crash barrier 1 as viewed from the side of the road such that the rear side of the crash barrier 1 according to the second embodiment of the present invention can be seen. FIG. 7 is a schematic exploded perspective view of the crash barrier 1 shown in FIG. 5 according to the second embodiment of the present invention. FIG. 8 is a schematic plan view of the crash barrier 1 shown in FIG. 5 according to the second embodiment of the present invention.

In the crash barrier 1 according to the second embodiment of the present invention shown in FIGS. 5 to 8, the connection part 12 is comprised of a separate inclined member. Specifically, in the crash barrier 1 according to the second embodiment of the present invention, the inclined member separated from the guardrail is disposed in the space between the support 10 and the rear side of the guardrail 11. One end of the inclined member is firmly fixed and coupled to the rear side of the guardrail 11. The other end of the inclined member is fixed to and combined with the support 10. In the crash barrier 1 according to the second embodiment of the present invention shown in FIGS. 5 to 8, this inclined member corresponds to the connection part 12.

Figure 9:
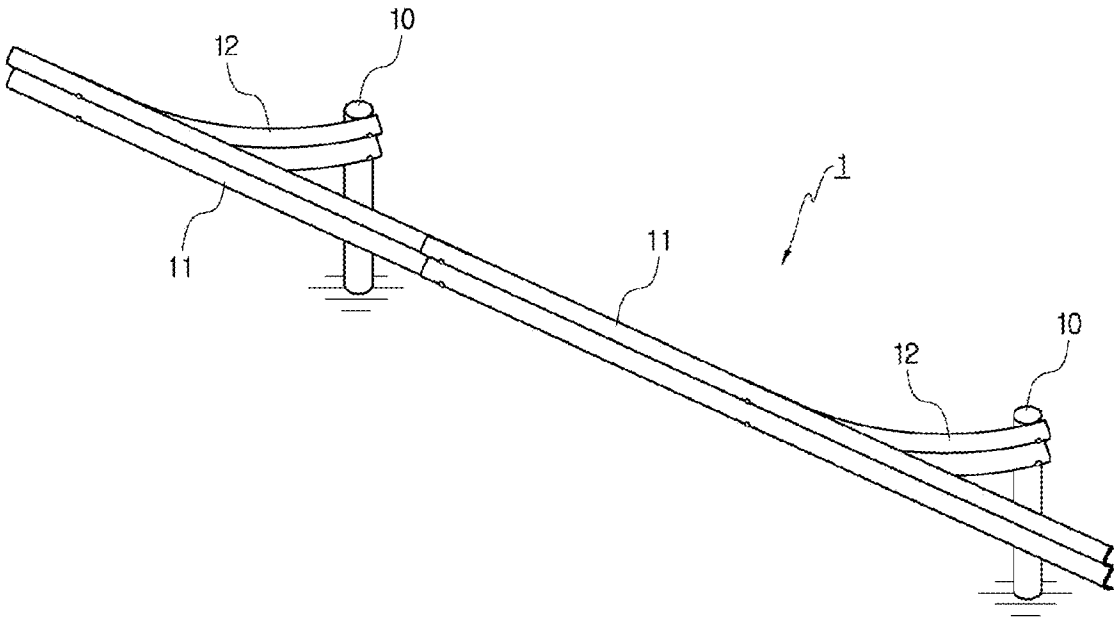
FIG. 9 is a schematic perspective view of a crash barrier which has been obtained by modifying the second embodiment according to a third embodiment of the present invention.
Figure 10:
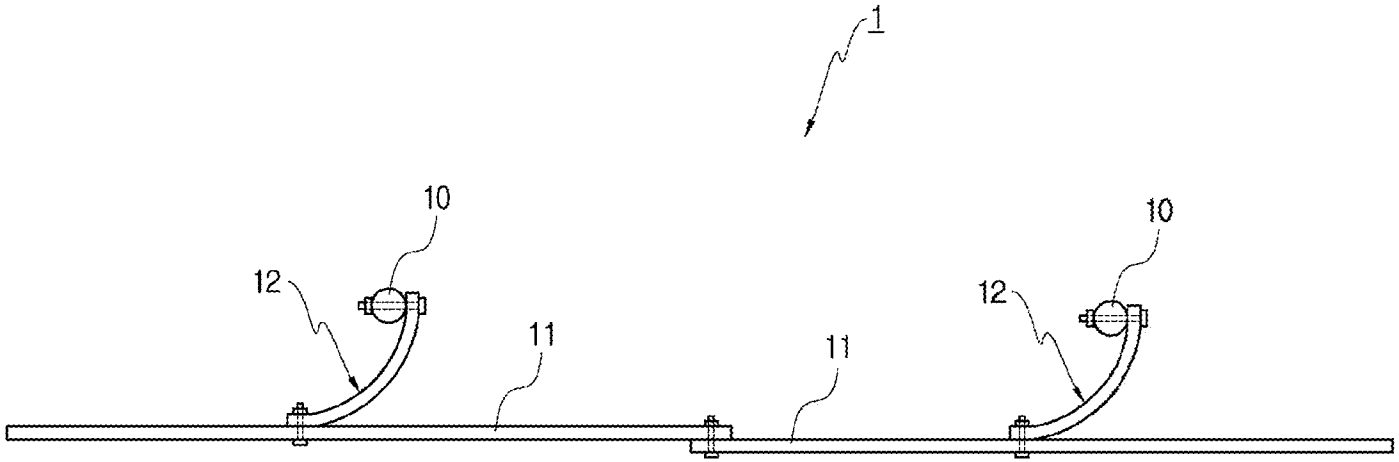
FIG. 10 is a schematic plan view of the crash barrier shown in FIG. 9 according to the third embodiment of the present invention.

As such, the inclined member separated from the guardrail is provided as the connection part 12. In particular, as shown in FIGS. 5 to 8, in the inclined member having a straight line shape, one end of the inclined member, which is fixed and coupled to the rear side of the guardrail 11, corresponds to an end 120 parallel with the rear side of the guardrail 11, and the other end of the inclined member, which is combined with the support 10, corresponds to an end 121 which is bent in a direction perpendicular to the guardrail 11 and is coupled to the side of the support 10 in the road traveling direction. However, unlike this, the inclined member corresponding to the connection part 12 may have a curved line shape as viewed from the top. FIG. 9 is a schematic perspective view of the crash barrier 1 as viewed from the road such that the front side of the crash barrier 1 according to a third embodiment obtained by modifying the second embodiment of the present invention can be seen. FIG. 10 is a schematic plan view of the crash barrier 1 according to the third embodiment of the present invention shown in FIG. 9. As described above, the connection part 12 may be comprised of the separate inclined member. Particularly, as shown in FIGS. 5 to 8, the inclined member may be straight line shaped. Also, as shown in FIGS. 9 and 10, the inclined member may be curved line shaped.

Figure 11:
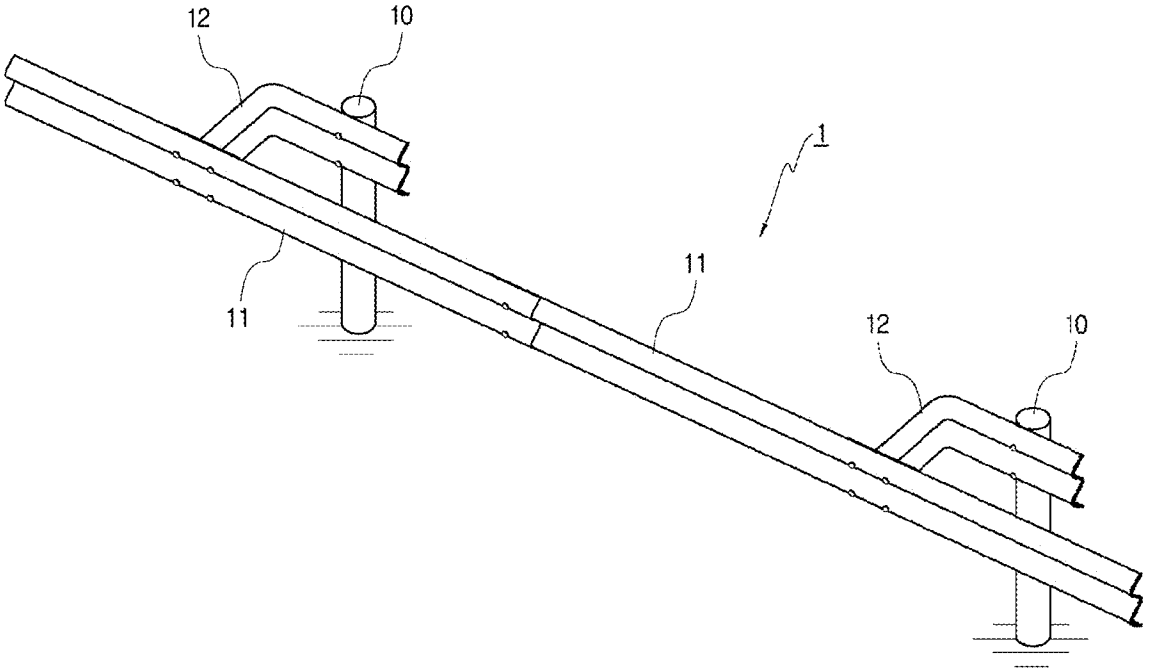
FIG. 11 is a schematic exploded perspective view of a crash barrier according to a fourth embodiment of the present invention.
Figure 12:
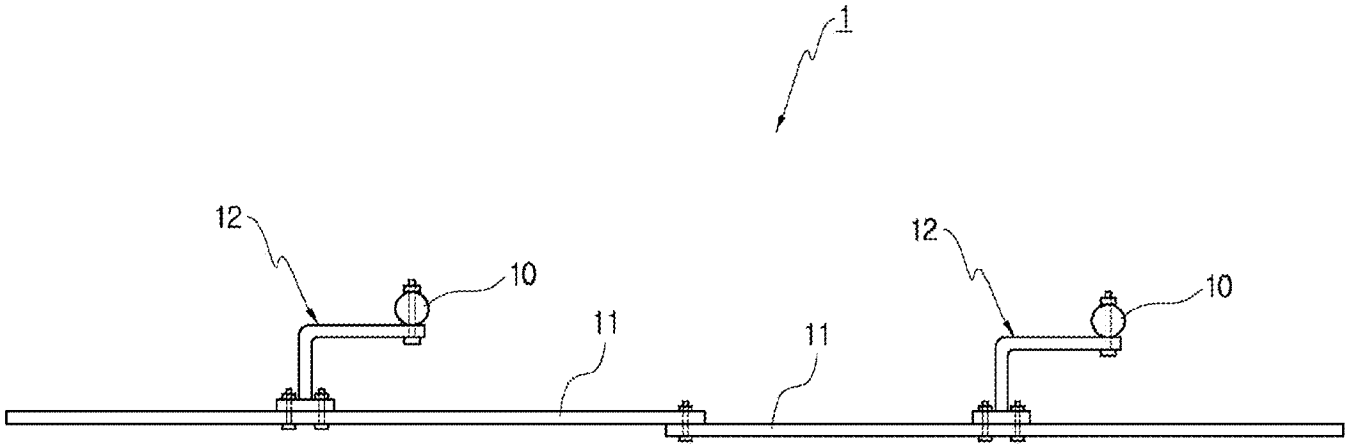
FIG. 12 is a schematic plan view showing that the crash barrier shown in FIG. 11 according to the fourth embodiment of the present invention has been assembled.

Furthermore, the member constituting the connection part 12 may be separated from the guardrail and may have a bent shape. FIG. 11 is a schematic exploded perspective view of the crash barrier 1 as viewed from the road such that the front side of the crash barrier 1 having the connection part 12 comprised of a bent member according to a fourth embodiment of the present invention. FIG. 12 is a schematic plan view showing that the crash barrier 1 shown in FIG. 11 according to the fourth embodiment of the present invention has been assembled. Even when the connection part 12 is comprised of the bent member, one end of the bent member is firmly fixed and coupled to the rear side of the guardrail 11, and the other end of the bent member is fixed to and combined with the support 10.

In each crash barrier 1 having the connection part 12 comprised of a member separated from the guardrail 11 according to the second to fourth embodiments of the present invention, the adjacent guardrails are coupled to each other in such a manner that the ends of the guardrails are overlapped with each other, so that the continuous front is obtained.

Figure 13:
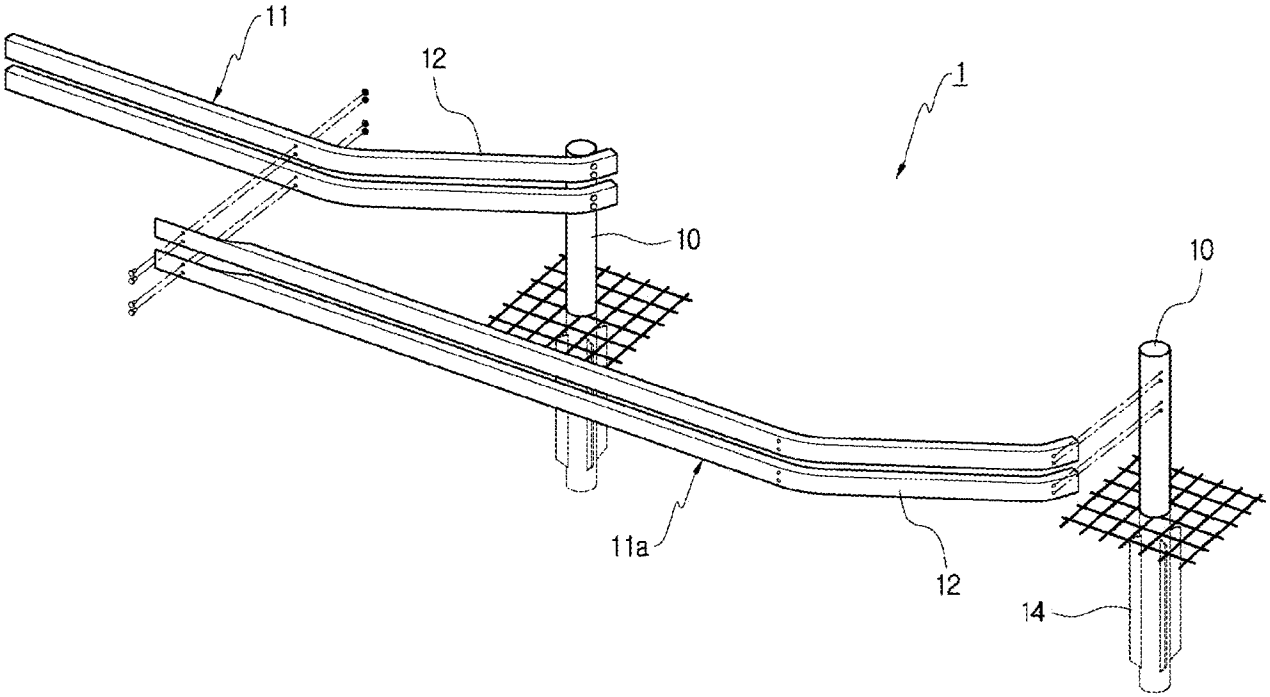
FIG. 13 is a schematic exploded perspective view showing that a guardrail is coupled to a guardrail adjacent to a support in a crash barrier according to a fifth embodiment of the present invention.
Figure 14:
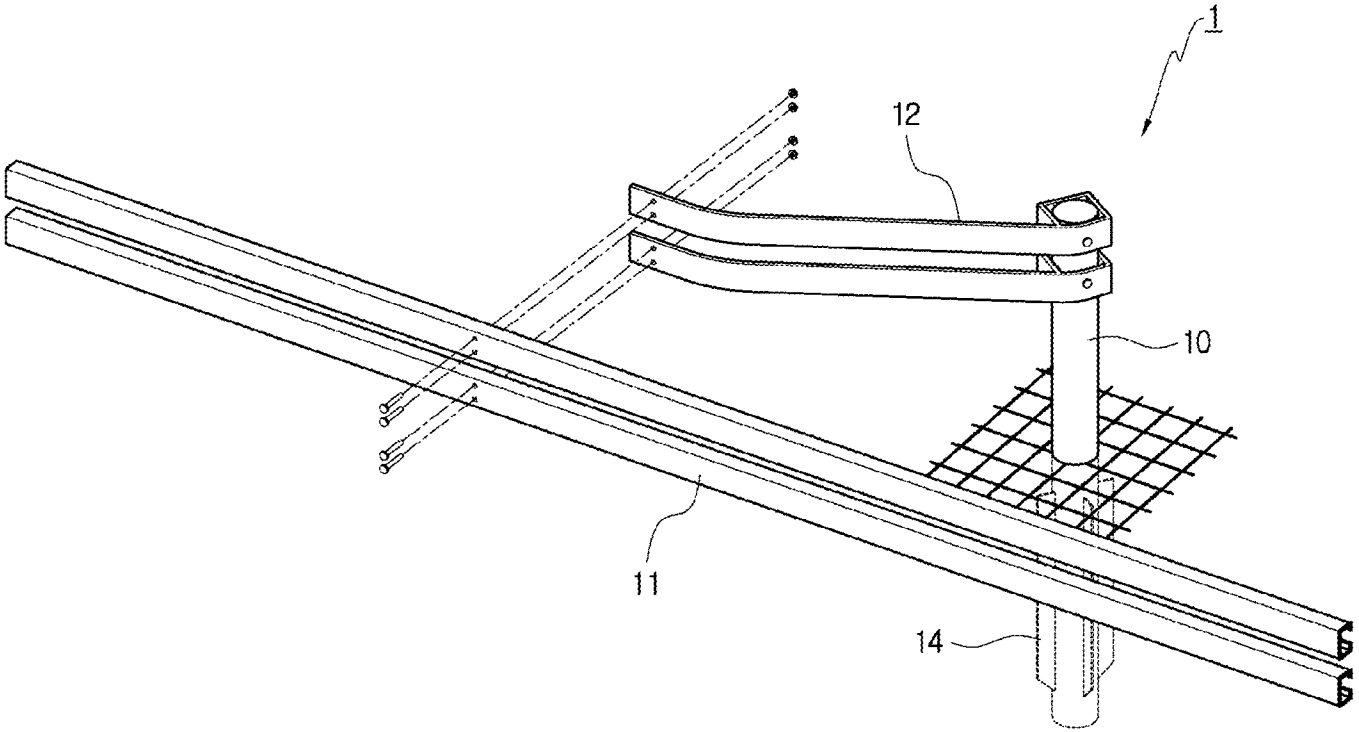
FIG. 14 is a schematic exploded perspective view showing that a guardrail is coupled to a connection part in a crash barrier according to a sixth embodiment of the present invention.

FIG. 13 shows the crash barrier 1 according to a fifth embodiment of the present invention. FIG. 13 is a schematic exploded perspective view showing that in the crash barrier 1 including the guardrail with a polygonal cross section, one end of the guardrail 11 forms the connection part 12, one guardrail 11 of the adjacent guardrails 11 and 11*a* is combined with the support 10, and the subsequent guardrail 11*a* is combined with the support 10 and is coupled to the already installed guardrail 11. FIG. 14 shows the crash barrier 1 according to a sixth embodiment of the present invention. FIG. 14 is a schematic exploded perspective view showing that in the crash barrier 1 including the guardrail 11 with a polygonal cross section, the connection part 12 is comprised of a member separated from the guardrail 11, and the guardrail 11 is coupled to the connection part 12 combined with the support 10. As shown in FIGS. 13 and 14, the guardrail 11 according to the embodiment of the present invention may be made up of not only a waveform plate member or a simple flat plate member but also a beam member with a polygonal cross section.

As described above, in the crash barrier 1 according to the embodiment of the present invention, a space is obtained by disposing the connection part 12 between the support 10 and the rear side of the guardrail 11, and the connection part 12 is disposed to be inclined to have a straight line shape or a curved line shape or has a bent shape. The front of the guardrail as viewed from the road has a continuity in the longitudinal direction of the road.

As such, the crash barrier 1 according to the embodiment of the present invention has the front side having a continuity in case of the vehicle collision and includes a sufficient space between the guardrail and the support. Therefore, when a vehicle collision, etc., occurs, the vehicle cannot directly contact with the support until the guardrail is sufficiently plastically deformed.

In particular, structurally speaking, the guardrail of the crash barrier can be referred to as a continuous beam with the support functioning as a point. Since the connection part 12 obtaining a space between the support 10 and the rear side of the guardrail 11 is disposed to be inclined or has a bent shape, the connection part has a modulus of elasticity less than that of the conventional connection part perpendicular to the rear side of the guardrail. Accordingly, at the time of the vehicle collision, a continuous beam composed of the guardrail becomes close to an infinite beam having unclear points, thereby improving impact energy-absorbing capacity.

Furthermore, as described above, since the connection part 12 obtaining a space between the support 10 and the rear side of the guardrail 11 is disposed to be inclined or has a bent shape, the impact energy due to the vehicle collision is not directly transferred to the support in a direction perpendicular to the guardrail. Accordingly, it is possible to improve the impact energy-absorbing capacity and to efficiently prevent injury to the riders of the vehicle and damage to the vehicle. Further, direct damage to the support is reduced and the crash barrier has a simpler structure, so that manufacture and installation cost of the crash barrier and a time required for installing the crash barrier can be reduced.

Figure 15:
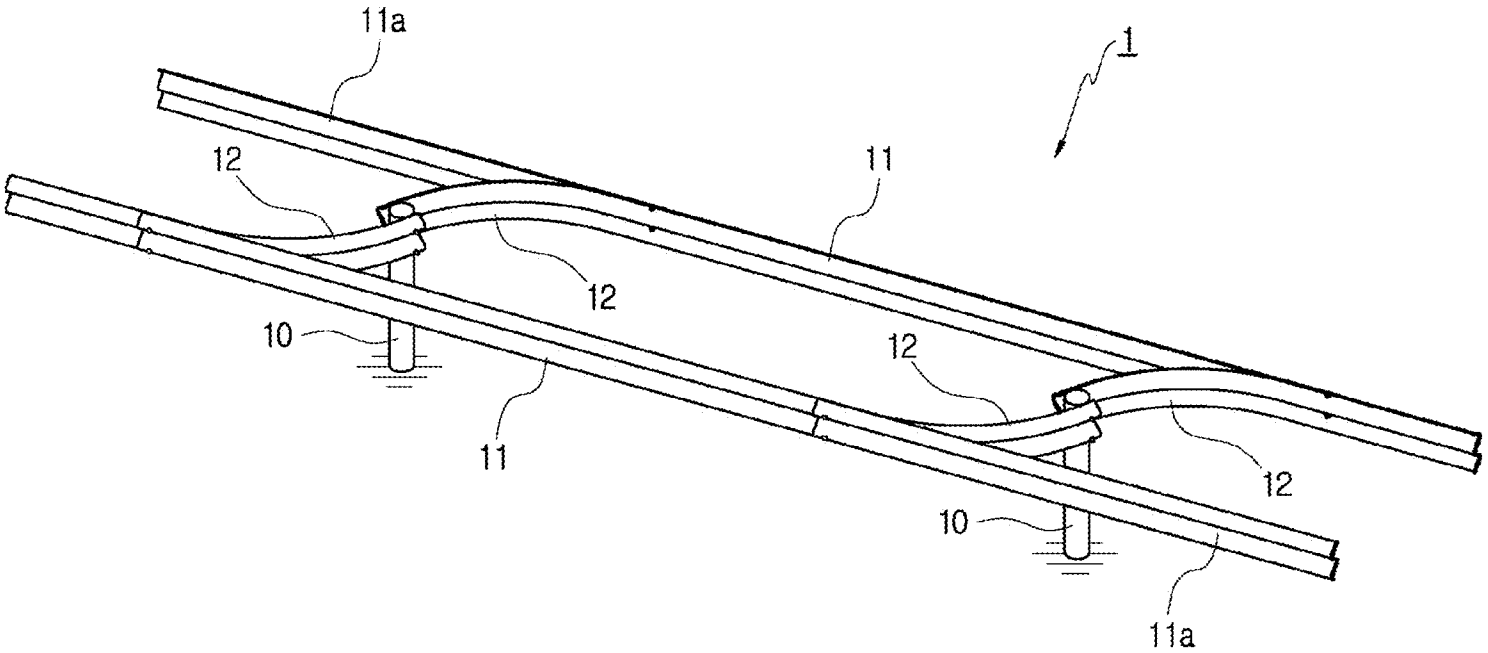
FIG. 15 is a schematic perspective view of a central reservation formed by using the crash barrier shown in FIG. 1.
Figure 16:
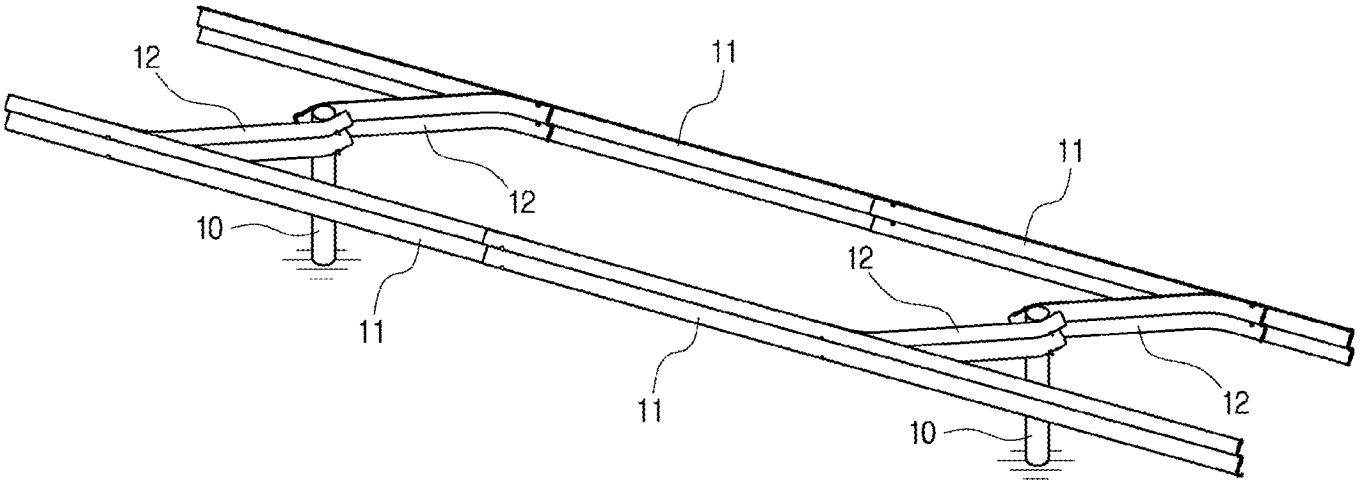
FIG. 16 is a schematic perspective view of a central reservation formed by using the crash barrier shown in FIG. 9.
Figure 17:
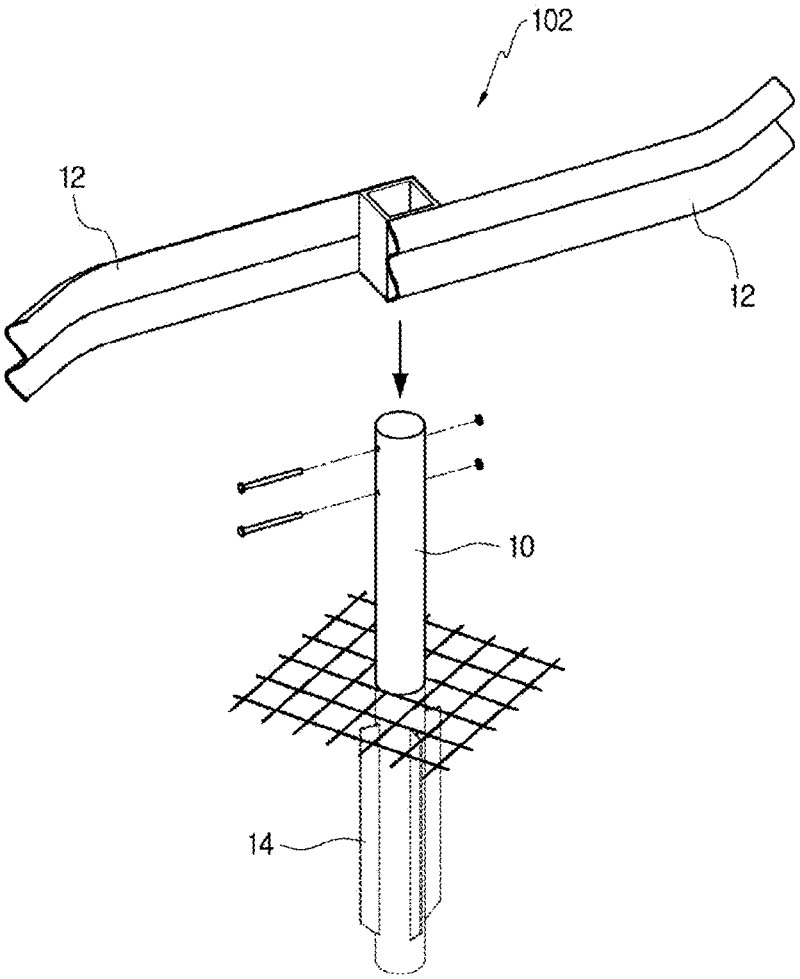
FIG. 17 is a schematic exploded perspective view showing that an assembly formed by coupling two connection parts is combined with the support in order to manufacture the central reservation shown in FIG. 16.

The above-described crash barrier 1 according to the embodiment of the present invention is installed not only on the side of the road but also on the center of the road, so that it can be used as a central reservation. When the crash barrier 1 is used as a central reservation, the guardrails 11 are provided in parallel on both sides of the support 10. FIG. 15 shows an example of the central reservation according to the embodiment of the present invention. FIG. 15 is a schematic perspective view showing that the central reservation has been formed by using the crash barrier 1 according to the first embodiment of the present invention shown in FIG. 1. FIG. 16 shows another example of the central reservation according to the embodiment of the present invention. FIG. 16 is a schematic perspective view showing that the central reservation has been formed by using the crash barrier 1 according to the second embodiment of the present invention. FIG. 17 is a schematic exploded perspective view showing that an assembly 102 formed by coupling two connection parts 12 is combined with the support 10 in order to manufacture the central reservation shown in FIG. 16.

As shown in the drawings, the guardrail 11 is installed respectively on both sides of the support 10 in the width direction of the road by using the connection part in accordance with the above-described configuration of the present invention, so that the central reservation can be formed. In particular, when the connection part 12 is comprised of a separate member as in the crash barrier 1 according to the aforementioned second to fourth embodiments, the assembly 102 is, as shown in FIG. 17, manufactured by coupling two connection parts 12, and the assembly 102 is firmly combined with the support 10. Then, the guardrail 11 is firmly coupled to each of the connection parts 12 of the assembly 102, so that the central reservation is manufactured.

The invention claimed is:

1. A crash barrier comprising:

a plurality of guardrail assemblies including a first guardrail assembly and a second guardrail assembly, each of the first guardrail assembly and the second guardrail assembly comprising, a guardrail extended in a longitudinal direction of a road, spaced apart from a support fixed to a ground by a distance, and having a first end and a second end, and a connection part, one end of the connection part integrally extended from the first end of the guardrail with a predetermined angle and another end of the connection part having a configuration to be attached to the support;

wherein the guardrail and the connection part constitute a single one-piece monolithic homogenous structure, and wherein the second end of the guardrail of the second guardrail assembly is attached to the guardrail of the first guardrail assembly with an overlap area therebetween by at least one fastener.

2. The crash barrier of claim 1, wherein the guardrail has a straight-line structure and the connection part has a curved structure.

3. The crash barrier of claim 1, wherein the first guardrail assembly and the second guardrail assembly have same structure.

4. The crash barrier of claim 1, wherein the at least one fastener is a bolt and nut coupling.

5. The crash barrier of claim 1, wherein a location that the second end of the guardrail of the second guardrail assembly is attached to the guardrail of the first guardrail assembly is not aligned with a location of the support.

6. The crash barrier of claim 1, wherein a combination between the second end of the guardrail of the second guardrail assembly and the guardrail of the first guardrail assembly constitutes a continuous crash barrier along the road.

7. The crash barrier of claim 1, wherein the guardrail and the connection part have same width and height.

8. The crash barrier of claim 1, wherein the guardrail and the connection part are made of same material.

9. The crash barrier of claim 1, wherein the guardrail and the connection part have same curved cross-section shape.

10. A crash barrier comprising:

a first guardrail assembly comprising:

a first guardrail extended along a road, spaced apart from a first support fixed to a ground by a distance, and having a first end and a second end, and a first connection part, one end of the first connection part integrally extended from the first end of the first guardrail with a predetermined angle and another end of the first connection part having a configuration to be attached to the first support, wherein the first guardrail and the first connection part constitute a first single one-piece monolithic homogenous structure; and a second guardrail assembly comprising:

a second guardrail extended along the road, spaced apart from a second support fixed to the ground by the distance, and having a first end and a second end, and a second connection part, one end of the second connection part integrally extended from the first end of the second guardrail with the predetermined angle and another end of the second connection part having a configuration to be attached to the second support, wherein the second guardrail and the second connection part constitute a second single one-piece monolithic homogenous structure;

wherein the second end of the second guardrail is attached to the first guardrail with an overlap area by at least one fastener.

11. The crash barrier of claim 10, wherein the first guardrail assembly and the second guardrail assembly have same structure.

12. The crash barrier of claim 10, wherein the first connection part has same width and height with the first guardrail, and the second connection part has same width and height with the second guardrail.

13. The crash barrier of claim 10, wherein each of the first guardrail and the second guardrail has a straight-line structure, and each of the first connection part and the second connection part has a curved structure.

14. The crash barrier of claim 10, wherein a location that the second end of the second guardrail is attached to the first guardrail is not aligned with a location of the first support.

15. The crash barrier of claim 10, wherein a combination between the first guardrail assembly and the second guardrail assembly constitutes a continuous crash barrier along the road.

16. The crash barrier of claim 10, wherein the first guardrail and the first connection part are made of same material, and the second guardrail and the second connection part are made of same material.

17. The crash barrier of claim 10, wherein the first guardrail and the first connection part have same curved cross-section shape, and the second guardrail and the second connection part have same curved cross-section shape.

18. A crash barrier comprising:

a plurality of guardrail assemblies, a first part of each of the plurality of guardrail assemblies extended in a longitudinal direction of a road, and spaced apart from a respective support fixed to a ground by a distance, and a second part of each of the plurality of guardrail assemblies bent from the first part of the each of the plurality of guardrail assemblies with a predetermined angle and connected to the respective support, wherein the first part of each of the plurality of guardrail assemblies and the second part of each of the plurality of guardrail assemblies constitute a single one-piece monolithic homogenous structure, and wherein the plurality of guardrail assemblies include a first guardrail assembly and a second guardrail assembly, the first guardrail assembly is attached to a second end of the second guardrail assembly at overlap area by at least one fastener which constitute a continuous crash barrier.

19. The crash barrier of claim 18, wherein the first guardrail assembly and the second guardrail assembly have same structure.

20. The crash barrier of claim 18, wherein the first part of each of the plurality of guardrail assemblies have same width and height with the second part of each of the plurality of guardrail assemblies.

* * * * *